United States Patent [19]

Wagner

[11] 4,094,644

[45] June 13, 1978

[54] CATALYTIC EXHAUST MUFFLER FOR MOTORCYCLES

[75] Inventor: Melvin H. Wagner, Bartlett, Ill.

[73] Assignee: UOP Inc., Des Plaines, Ill.

[21] Appl. No.: 638,778

[22] Filed: Dec. 8, 1975

[51] Int. Cl.[2] ..... B01J 8/00; F01N 3/15

[52] U.S. Cl. ..... 23/288 F; 23/288 FC

[58] Field of Search ..... 23/288 F, 288 FA, 288 FB, 23/288 FC

[56] References Cited

U.S. PATENT DOCUMENTS

| | | | |
|---|---|---|---|
| 2,898,202 | 8/1959 | Houdry et al. | 23/288 FC UX |
| 3,166,382 | 1/1965 | Purse et al. | 23/288 F |
| 3,166,895 | 1/1965 | Slayter et al. | 23/288 FC X |
| 3,180,712 | 4/1965 | Hamblin | 23/288 FA UX |
| 3,189,418 | 6/1965 | Gary | 23/288 FC UX |
| 3,220,179 | 11/1965 | Bloomfield | 23/288 F X |
| 3,445,196 | 5/1969 | Thomas | 23/288 FB UX |
| 3,473,323 | 10/1969 | Briggs et al. | 23/288 F UX |
| 3,594,131 | 7/1971 | DePalma et al. | 23/288 F |
| 3,695,851 | 10/1972 | Perga | 23/288 F |
| 3,698,875 | 10/1972 | Yamada | 23/288 F |
| 3,754,619 | 8/1973 | McCormick | 23/288 F X |
| 3,799,748 | 3/1974 | Scheitlin et al. | 23/288 F |
| 3,824,790 | 7/1974 | Thomaides | 23/288 F X |
| 3,861,881 | 1/1975 | Nowak | 23/288 FC X |
| 3,945,806 | 3/1976 | Musall et al. | 23/288 FC |

*Primary Examiner*—Barry S. Richman

*Attorney, Agent, or Firm*—James R. Hoatson, Jr.; Barry L. Clark; William H. Page, II

[57] ABSTRACT

Elongated, small diameter muffler assembly especially adapted for use on motorcycles has perforated tube and bulkhead portions at its entrance end for damping and diffusing the entering exhaust gas pulses to reduce their energy and to protect a ceramic catalytic element mounted within the muffler housing. Perforated tube and bulkhead portions at the exit end provide sound abatement and are sized to accomodate the increased volume of gases resulting from the heating provided by the catalyst element. The catalyst element is supported at each end in a manner which permits a sliding longitudinal movement relative to the housing by means of perforated tubes which are rigidly attached to the muffler housing at their outer ends only, while being free to thermally expand axially inwardly toward the catalytic element at a rate independent of the thermal growth of the muffler housing. The configuration of the exhaust gas flow path and the lengths of the inner metal elements and the ceramic catalyst element located inside the housing are selected to insure that the ceramic catalyst element is firmly restrained against vibratory movement in an axial direction as the outer housing expands at a higher expansion rate than the ceramic element during high temperature operation.

7 Claims, 4 Drawing Figures

CATALYTIC EXHAUST MUFFLER FOR MOTORCYCLES

BACKGROUND OF THE INVENTION

This invention relates to mufflers and particularly to mufflers for motorcycles which include structure for fluid treatment in addition to structure for silencing. Catalytic converters for treating automotive exhaust gases are available in a variety of configurations. Although such devices are commonly provided as a separate unit in addition to the usual muffler, it is known to provide a combined muffler and catalytic converter unit as taught by U.S. Pat. No. 3,445,196, for example. Providing a catalytic converter for use on motorcycles has been very difficult for several reasons. There is very limited space available in the region of the engine exhaust manifold such that an attempt to locate a catalytic converter near the manifold, where it operates most effectively, could result in too much heat too close to the driver's body and exhaust pulses of such magnitude and frequency that it would be most difficult to protect the catalyst element from being damaged thereby. Because of space limitations, a desire to shield the driver and any rider from excessive heat, and esthetic considerations, it would seem desirable to mount a catalyst element within a muffler housing. However, many problems are presented. These include reduction of the space available for sound treatment, increased backpressure, damage to relatively fragile catalyst elements by the exhaust pulses which are especially severe, and a difference in the coefficients of thermal expansion between the muffler housing and the catalyst element.

SUMMARY

It is among the objects of the present invention to provide an improved muffler which overcomes the problems of the prior art. The improved muffler incorporates a catalyst element and includes structure which dampens the exhaust pulses going to the catalyst element. The invention uses a radial flow catalyst element, preferably of the type having a wound ceramic yarn substrate. Such an element contributes a minimum of backpressure while aiding in noise suppression by changing the direction of flow of the exhaust gases. In one embodiment, where the muffler housing has an oval cross-section, inlet and outlet tubes are welded to a metal housing. Substantial portions of the tubes which extend toward each other within the housing are perforated so that exhaust gases may flow radially back and forth between the tubes and the chambers formed between the outside surface of the tubes and the inside surface of the housing.

DETAILED DESCRIPTION

Figures 1, 2, 3, 4:
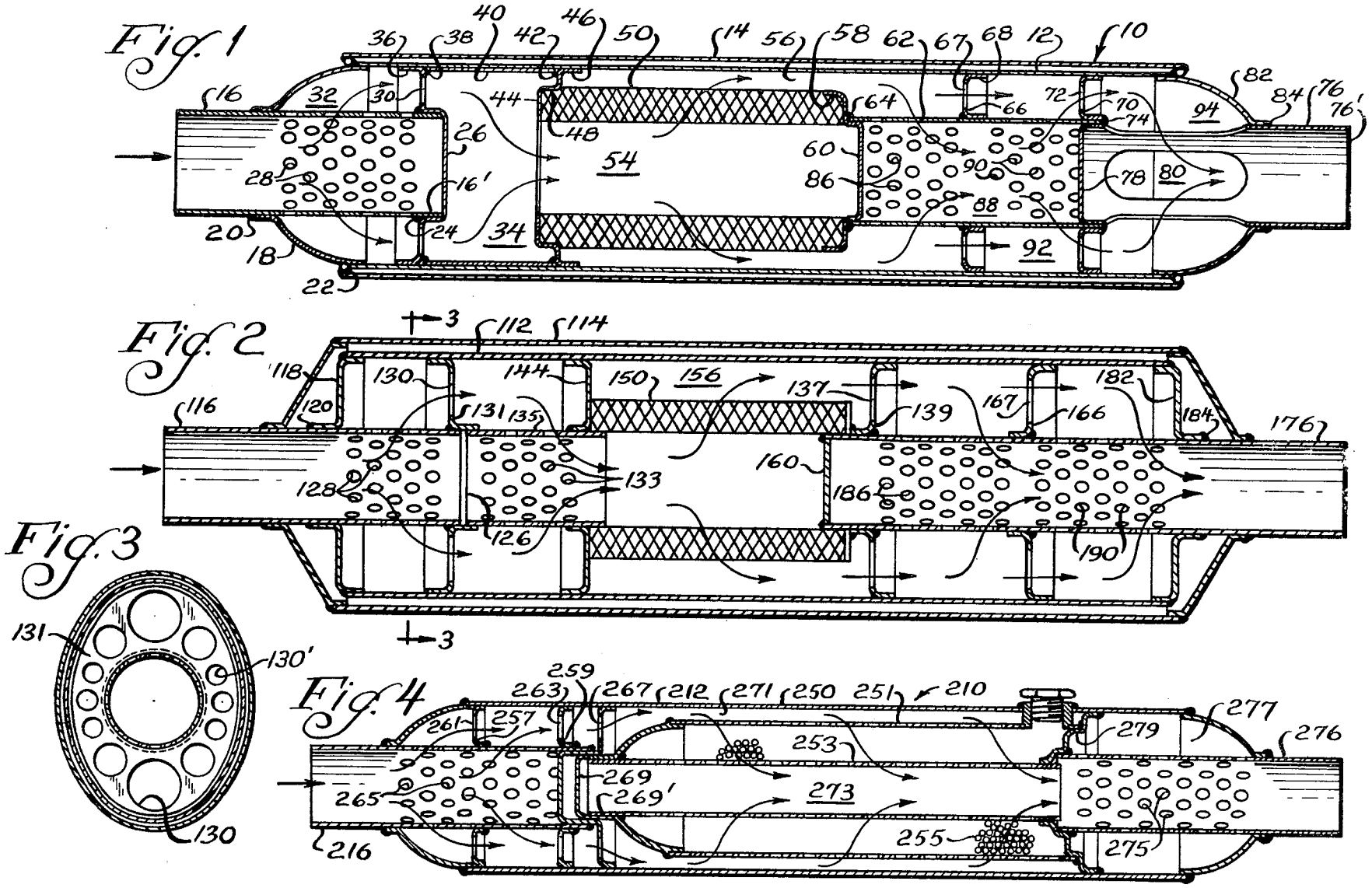
FIG. 1 is a longitudinal sectional side view of a muffler device containing a monolithic catalyst element and having a circular cross-sectional configuration.
FIG. 2 is a longitudinal sectional side view of a muffler device containing a monolithic catalyst element and having an oval cross-sectional configuration.
FIG. 3 is a sectional view taken on line 3—3 of FIG. 2.
FIG. 4 is a longitudinal sectional side view of a muffler device containing a pellet type catalyst element and having a circular cross-sectional configuration.

Referring to FIG. 1, the muffler device indicated generally at 10 includes a tubular housing or wrapper 12 which may be formed of type 304 stainless steel or other material suitable for the high temperatures and corrosive environment to which the device is subjected. A tubular heat shield 14 is preferably welded to the ends of wrapper 12 and radially spaced therefrom to provide insulation. The inlet end of the muffler 10 comprises an inlet tube 16 for receiving exhaust gases which is joined to the wrapper 12 by an inlet transition and end cap member 18. The member 18 is welded to the inlet tube at 20 and to the wrapper at 22. The inner end 16' of the tube 16 is welded at 24 to a first bulkhead member 26 which closes off its inner end and centers the tube 16 relative to the wrapper 12. Perforations 28 in the tube 16 and perforations 30 in bulkhead 26 permit exhaust gases inside tube 16 to move radially outwardly into a first chamber 32 and thence axially forward into second chamber 34. An axially extending flange 36 on bulkhead member 26 is free to slide along the inner wall of the wrapper 12 in response to dimensional changes produced by thermal differences. The bulkhead 26 is welded at 38 to an annular ring member 40 which is welded at 42 to a second bulkhead member 44. The second bulkhead member 44 is unperforated and has an outer flange portion 46 which can slide along the inner wall of wrapper 12 and a recess portion 48 which receives the inlet end of a monolithic catalyst element 50. The area between the first and second bulkheads 26, 44 defines the second chamber 34 while the areas inside and outside the catalyst element 50 define third and fourth chambers 54, 56. The downstream end of the catalyst element 50 is supported in a recess 58 in an end cap member 60 which blocks the axial flow of exhaust gases and forces them to travel radially outwardly through the catalyst 50 from chamber 54 to chamber 56. The end cap 60 is carried at one end of a perforated tube member 62 to which it is welded at 64. A third bulkhead 66, which includes perforations 67, is welded to tube 62 near its center and includes a flange portion 68 in sliding contact with the inner wall of wrapper 12. A fourth bulkhead 70, which includes openings 72 is welded to tube 62 at 74 and includes a flange portion in sliding contact with the inner wall of wrapper 12. An outlet pipe 76 telescopes inside tube 62 and is welded thereto at 74. The inlet end of outlet pipe 76 is closed by a plate 78. The pipe 76 includes side openings 80 and is welded to the outlet transition and end cap member 82 at 84. The holes 67 in bulkhead 66 permit the passage of a portion of the gases while the remainder of the gases leaving chamber 56 move radially inwardly through a first set of sound abatement perforations 86 to chamber 88 formed in the inside of tube 62. The gases then move radially outwardly through a second set of perforations 90 to chamber 92 from whence they pass through axial openings 72 in bulkhead 70 to chamber 94. The gases then again move radially inwardly through elongated openings 80 in outlet tube 76 and are exhausted from the outer end 76' of tube 76.

From the preceding description, it is readily evident that the hot exhaust gases continually change their direction. Each direction change absorbs some of the energy in the gas and thus reduces the sound of the gases in addition to evening out the exhaust pulses and reducing the impact of the gases on the catalyst element 50. Furthermore, since the internal elements are only welded to the outer housing ends 18, 82 at 20 and 84, the forces which might be applied to rigidly affixed internal bulkheads as a result of the extreme temperature differences produced by the catalytic converter 50, are obviated. The metal members which are internal to the housing 12 could be expected to become hotter during use and thus expand axially toward the ceramic element 50 at a greater rate than the radially adjacent portions of the housing. However, the ceramic element 50 would have a lower temperature coefficient of expansion than the portions of the metal housing which are radially adjacent to it and would thus tend to offset the higher expansion of the inner metal elements which support it. Since it is desirable to maintain the monolith retaining elements 48, 58 in firm contact with the monolith 50, the axial lengths of the various metal and ceramic elements are selected so that the axial expansion of the inner metal and ceramic members at the operating temperature of the unit will be equal to or slightly greater than the expansion of the outer housing 12. Since motorcycle engines can tolerate very little back pressure in the exhaust system, the various openings in the unit are sized to minimize back pressure. For example, in the disclosed embodiment, where the inlet and outlet tubes 16, 76 each have an open area of 2.76 $in^2$, the inlet tube perforations 28 have an open area of 4.2 $in^2$, the spaced perforations 30 have an open area of 3.7 $in^2$ and the ceramic element 50 has an I.D. open area of 6.3 $in^2$ and an O.D. open area of 8.8 $in^2$. The annular area of chamber 56 is 4.2 $in^2$. The open area of holes 67 and 72 in each of the bulkheads 66, 70 is 3.7 $in^2$ while the area of the sound abatement holes 86 and 90 totals 6.0 $in^2$ and the area of openings 80 totals 10.1 $in^2$.

The embodiment 100 of FIG. 2 is quite similar to the embodiment 10 of FIG. 1 but is oval, as seen in the FIG. 3 section view, rather than round so that it may be used in locations where a smaller dimension in one direction is required. The gas flow varies somewhat from FIG. 1 in that the incoming gases move radially outwardly through perforations 128 in tube 116, pass through varying size apertures 130, 130' in bulkhead 131 and return inwardly through perforations 133 in tube 135 before passing through catalyst element 150 and openings 137 in bulkhead 139. The gases exiting the openings 137 diffuse partially through openings 167 in bulkhead 166 and holes 190 and partially through sound abatement holes 186 before exiting from outlet tube 176. The even number reference characters from 110–190 shown in FIG. 2 correspond to the like number reference characters 10–90 in FIG. 1. As in FIG. 1, the catalyst element 156 is mounted in between a pair of metallic retaining members 144, 160 which are free to expand relative to the housing 112 with increases in temperature. Suitable open areas for the various portions of the FIGS. 2 and 3 design include 2.4 $in^2$ for each of the tubes 116, 176; 3.0 $in^2$ for each of the sets of holes 128, 133; 3.5 $in^2$ for openings 130, 137 and 167; and 5.2 $in^2$ for the inner surface of ceramic monolith 150; 8.6 $in^2$ for the outer monolith surface; and 4.2 $in^2$ for each of the sets of holes 186, 190.

The embodiment 210 shown in FIG. 4 is similar to the embodiments of FIGS. 1 and 2 in that the gas flow is caused to move alternately in a radially inward and radial outward fashion from the time it enters inlet tube 216 until the time it leaves outlet tube 276. However, the catalytic converter member 250 is not a ceramic monolith, but rather, a pellet type including an outer perforated screen 251, an inner perforated screen 253, and a plurality of catalyst coated pellets 255 packed between the two screens. The inlet bulkheads 257,259 which support the inlet tube 216 for free axial expansion relative to housing 212 have openings 261,263 through which gases passing outwardly through apertures 265 may be directed through openings 267 in converter support bulkhead 269 to outer chamber 271 and thence through the converter to inner chamber 273. Although the chamber 273 communicates directly with the outlet tube 276, a plurality of apertures 275 permit a portion of the gases to flow into and out of closed chamber 277 to provide some sound attenuation. As in the embodiments of FIGS. 1 and 2, provisions for accommodating thermal expansion are also important in the FIG. 3 embodiment. The right end of the outer converter screen 251 and the left end of outlet tube 276 are welded to bulkhead member 279. The left end of the screen 251 is free to slide axially along the walls 269' of a cupped recess portion of bulkhead 269. The inner screen 253 is welded to outer screen 251 at its left end but is free to slide axially inside bulkhead 279 at its right end. The bulkhead member 279 is generally corrugated, the corrugations providing a degree of flexibility serving to accommodate axial movement of tube 276, and inner screen 251. Suitable open areas for the various portions of the FIG. 3 design include 1.48 $in^2$ for each of the tubes 216,276; 1.55 $in^2$ for the openings 261,263 in each of the bulkheads 257,259; 3.2 $in^2$ for the openings 267 in bulkhead 269; 17.3 $in^2$ for the open area of screen 251; 8.2 $in^2$ for the open area of screen 253; and 3.6 $in^2$ for the apertures 275 in outlet tube 276. Although the housing 212 is not shown as being mounted within an outer heat shield, as shown in FIGS. 1 and 2 at 14,114, such a shield could certainly be used, depending on the operating environment.

I claim as my invention:

1. An exhaust muffler comprising a metal exhaust inlet tube and a coaxial metal exhaust outlet tube, said tubes being longitudinally spaced from each other and welded adjacent their far ends to an elongated metal housing member, said metal housing member having a larger diameter than said tubes and being joined to said tubes by inlet and outlet transition portions; an elongated, hollow, annular, radial flow catalytic converter member comprising a monolithic ceramic substrate positioned intermediate the inner ends of said tubes and axially aligned therewith, said catalytic converter member having its radially outer surface spaced inwardly from the inner wall of said metal housing, a plurality of bulkhead members fixedly mounted relative to portions of said tubes inwardly of the far ends thereof for axial movement with said tubes as said tubes move inside and relative to said housing due to temperature differences between said tubes and said housing, at least one of said bulkhead members being inwardly axially spaced from both said inlet and outlet tubes, said plurality of bulkhead members including axially extending flange portions which contact the inner wall of said housing around their periphery so as to prevent radial movement of said tubes and bulkhead members while permitting axial sliding movement of said bulkhead members; said catalytic converter member being mounted intermediate said inlet and outlet tubes and intermediate a pair of said plurality of bulkhead members, said catalytic converter member being mounted at its upstream end to said one of said slidably movable bulkhead members which is inwardly axially spaced from said inlet and outlet tubes and at its downstream end to said outlet tube, blocking means for blocking gas flow through the downstream end of said inlet tube and through the downstream end of said hollow catalytic converter member; said tubes, and at least some of said plurality of bulkhead members being perforated to force the exhaust gas flow within said muffler to move radially outwardly and radially inwardly between the inner walls of said tubes and catalytic converter member and the inner walls of said metal housing in at least two cycles.

2. The exhaust muffler of claim 1 wherein said monolithic ceramic substrate is formed of wound ceramic yarn.

3. The exhaust muffler of claim 1 wherein said inlet and outlet tubes each include support means for retaining the ends of said ceramic substrate, said support means for retaining producing an axial retaining thrust on said ceramic substrate which is at least as great when said catalytic converter is at operational temperatures as when it is at ambient temperatures.

4. An exhaust muffler comprising a metal exhaust inlet tube and a coaxial metal exhaust outlet tube, said tubes being longitudinally spaced from each other and welded adjacent their far ends to an elongated metal housing member, said metal housing member having a larger diameter than said tubes and being joined to said tubes by inlet and outlet transition portions; an elongated, hollow, annular, radial flow catalytic converter member comprising a monolithic ceramic substrate positioned intermediate the inner ends of said tubes and axially aligned therewith, said catalytic converter member having its radially outer surface spaced inwardly from the inner wall of said metal housing, a plurality of bulkhead members fixedly mounted relative to portions of said tubes inwardly of the far ends thereof for axial movement with said tubes as said tubes move inside and relative to said housing due to temperature differences between said tubes and said housing, a tubular axial extension means mounted to the downstream end of said inlet tube and having a bulkhead member fixedly mounted thereto for axial movement therewith, said plurality of bulkhead members including axially extending flange portions which contact the inner wall of said housing around their periphery so as to prevent radial movement of said tubes and bulkhead members while permitting axial sliding movement of said bulkhead members; said catalytic converter member being mounted intermediate said inlet and outlet tubes and intermediate a pair of said plurality of bulkhead members, said catalytic converter member being mounted at its upstream end to said slidably movable bulkhead member which is affixed to said axial extension means and at its downstream end to said outlet tube, blocking means for blocking gas flow between the downstream end of said inlet tube and said axial extension means and through the downstream end of said hollow catalytic converter member; said tubes, said axial extension means, and at least some of said plurality of bulkhead members being perforated to force the exhaust gas flow within said muffler to move radially outwardly and radially inwardly between the inner walls of said tubes and catalytic converter member and the inner walls of said metal housing in at least two cycles.

5. The exhaust muffler of claim 4 wherein said monolithic ceramic substrate is formed of wound ceramic yarn.

6. The exhaust muffler of claim 4 wherein said inlet and outlet tubes each include support means for retaining the ends of said ceramic substrate, said support means for retaining producing an axial retaining thrust on said ceramic substrate which is at least as great when said catalytic converter is at operational temperatures as when it is at ambient temperatures.

7. An exhaust muffler comprising a metal exhaust inlet tube and a coaxial metal exhaust outlet tube, said tubes being longitudinally spaced from each other and welded adjacent their far ends to an elongated metal housing member, said metal housing member having a larger diameter than said tubes and being joined to said tubes by inlet and outlet transition portions; an elongated, hollow, annular, radial flow catalytic converter member comprising a pair of perforated inner and outer housing portions which define a catalyst bed containing a plurality of catalyst coated pellets, said converter member being positioned intermediate the inner ends of said tubes and axially aligned therewith, said catalytic converter member having its radially outer housing portion spaced inwardly from the inner wall of said metal housing, a plurality of bulkhead members fixedly mounted relative to portions of one of said tubes for axial movement with said one tube as said tube moves inside and relative to said housing due to temperature differences between said tube and said housing, said plurality of bulkhead members including axially extending flange portions which contact the inner wall of said housing around their periphery so as to prevent radial movement of said tube and bulkhead members while permitting axial sliding movement of said bulkhead members; said catalytic converter member being mounted intermediate said inlet and outlet tubes and being slidably supported for axial movement at one end by one of said plurality of bulkhead members, and on the other end by a flexible bulkhead member affixed to said metal housing and the other of said tubes, said catalytic converter member having its inner and outer housing portions joined at one end by said flexible bulkhead member and at its other end by a transition member, blocking means for blocking gas flow through the downstream end of said inlet tube and through the upstream end of said hollow catalytic converter member; said tubes, and at least some of said plurality of bulkhead members being perforated to force the exhaust gas flow within said muffler to move radially outwardly and radially inwardly between the inner walls of said tubes and catalytic converter member and the inner walls of said metal housing.

* * * * *